United States Patent [19]

Stahl et al.

[11] 4,002,187

[45] Jan. 11, 1977

[54] FLY SHUTTLE LOOM SHUTTLE BOX

[75] Inventors: Joseph E. Stahl, Easthampton; William J. Hanson, Stow, both of Mass.

[73] Assignee: J. P. Stevens & Co., Inc., New York, N.Y.

[22] Filed: May 27, 1975

[21] Appl. No.: 581,213

Related U.S. Application Data

[63] Continuation-in-part of Ser. No. 507,083, Sept. 18, 1974, abandoned.

[52] U.S. Cl. ..... 139/185

[51] Int. Cl.[2] ..... D03D 49/54

[58] Field of Search ..... 139/183–187, 139/166

[56] References Cited

UNITED STATES PATENTS

| | | | |
|---|---|---|---|
| 3,005,471 | 10/1961 | Reuther et al. | 139/166 |
| 3,429,345 | 2/1969 | O'Donnell | 139/186 |
| 3,901,288 | 8/1975 | Benedict et al. | 139/185 |

FOREIGN PATENTS OR APPLICATIONS

| | | | |
|---|---|---|---|
| 7,903 | 10/1905 | Denmark | 139/185 |
| 384,496 | 2/1965 | Switzerland | 139/185 |
| 721,546 | 1/1955 | United Kingdom | 139/185 |
| 246,410 | 10/1969 | U.S.S.R. | 139/185 |

*Primary Examiner*—James Kee Chi
*Attorney, Agent, or Firm*—Robert Ames Norton; Michael T. Frimer; Saul Leitner

[57] ABSTRACT

A fly shuttle loom shuttle box is provided with a solid elastomer binder attached at both ends in place of a conventional pivoted, rigid-backed binder. In one modification there is attached to the end of the binder a pivoted extension which permits use of dagger fingers in the normal position on a loom. The greater force exerted by the binder results in improved shuttle deceleration when it enters the shuttle box. This also eliminates picker stick over throw when accelerating the shuttle, which permits, when in proper adjustment, in some cases elimination of picker stick loom side bumper and check strap without, of course, eliminating their useful functions. As there is a considerable amount of heat developed by the flexing of the solid elastomer, it is desirable to provide for ventilation in the form of a few relatively large holes in the elastomer near its center and adjacent to the leather face of the binder.

4 Claims, 6 Drawing Figures

Fig. 3.
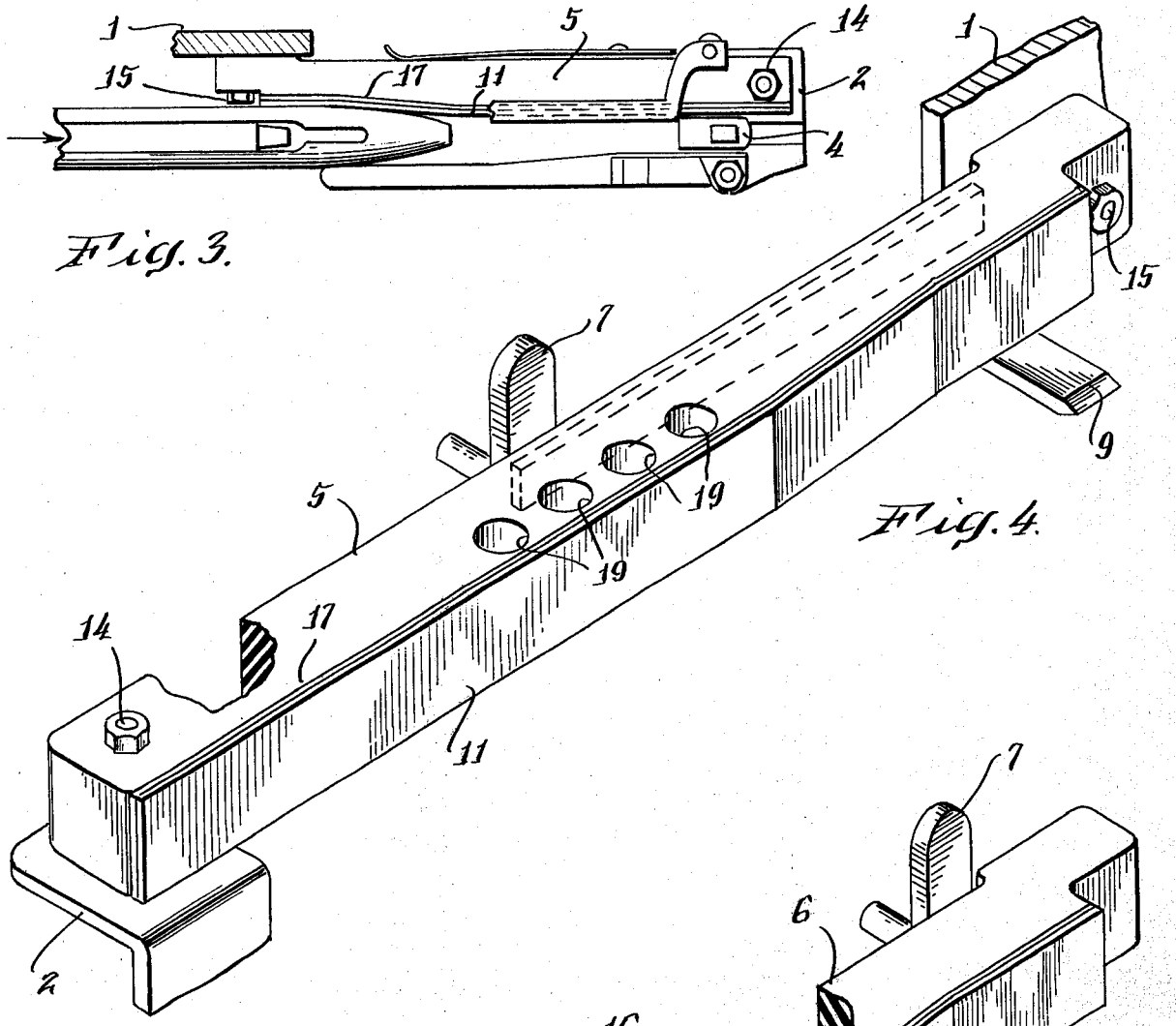
Fig. 4.
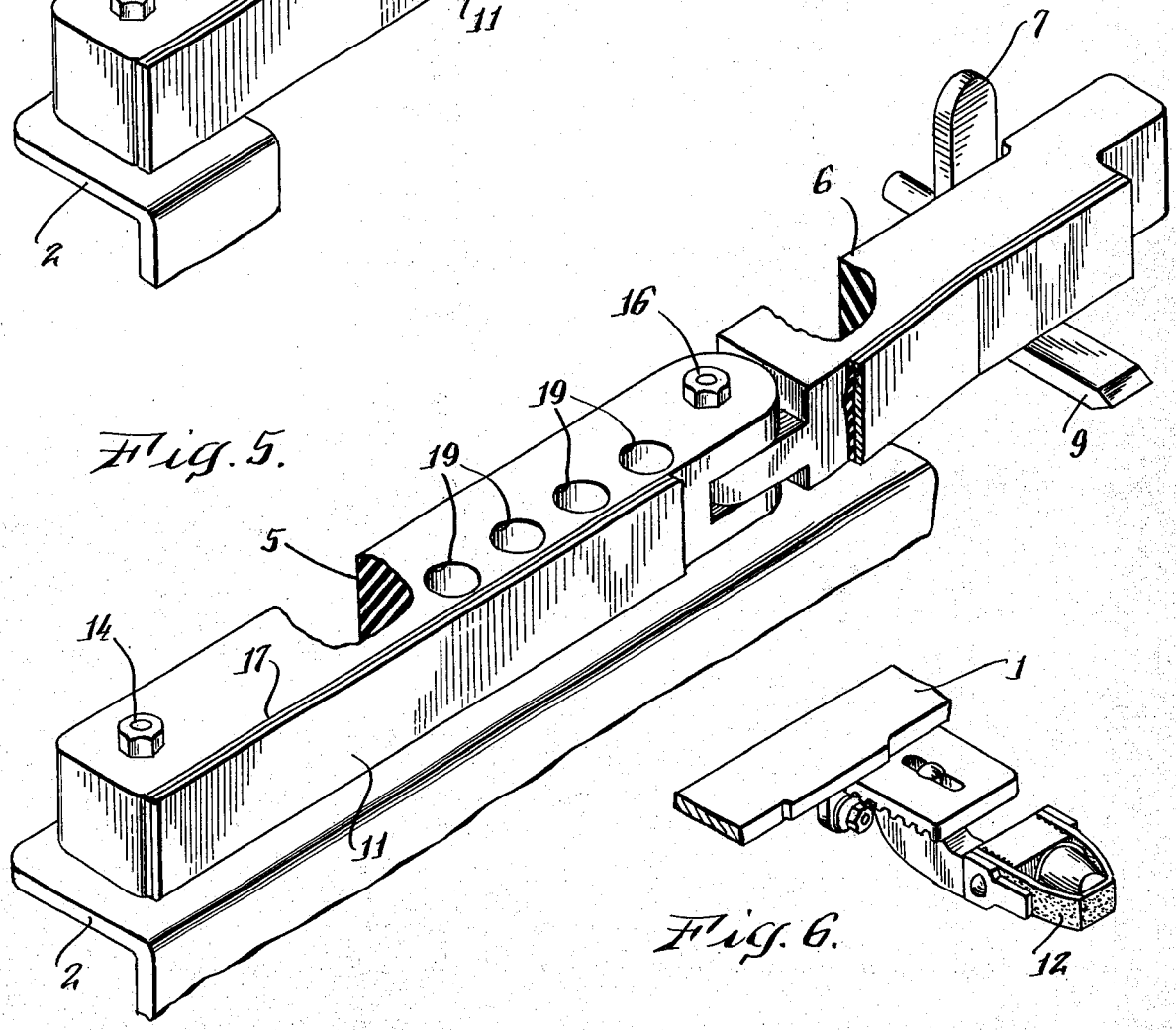
Fig. 5.
Fig. 6.

FLY SHUTTLE LOOM SHUTTLE BOX

RELATED APPLICATION

This application is a continuation-in-part of our earlier application Ser. No. 507,083, filed Sept. 18, 1974, which application is now abandoned.

BACKGROUND OF THE INVENTION

In an ordinary fly shuttle loom, shuttle boxes are provided at each end with binders, normally leather-lined, to decelerate the shuttle on entering the box. In the ordinary loom this binder is a pivoted, rigid element which is under spring tension. Because of the relatively low friction on the shuttle the picker stick can overshoot, both on the forward movement of the shuttle and on the movement of the picker stick from an incoming shuttle. This normally requires a bumper on the loom and check straps for each picker stick. The relatively low friction also results in more noise in the shuttle box and greater transmission of vibrations to the loom frame through the rigid, pivoted binder.

An elastomer binder has been described in the British Pat. No. 721,546. The elastomer is provided with slanted, oblong holes so that is is compressible from front to back. In most of the description the compressible elastomer is mounted on a rigid backplate, which may be pivoted, in other words, of the same design as has been referred to above in general for looms. This portion of the patent, as will appear below, is not pertinent to the present invention. However, on page 2, in the paragraph beginning on line 31, there is a brief mention of an alternate structure in which the binder is wholly of resilient material and may be fixed. The patent makes it very clear that the braking force which decelerates the shuttle results from compression of the elastomer, made possible by the numerous slanted, oblong holes.

As far as noise is concerned, in the patent of Stahl and Cudworth, U.S. Pat. No. 3,868,975, Mar. 4, 1975, and assigned to the assignee of the present application, there is described and claimed reduction of noise in fly shuttle looms by lining various elements of the shuttle boxes and other portions of the loom with elastomers, which reduce noise and, what is sometimes more important, reduce transmission of vibrations to the loom frame, which resonates. This noise reduction is of increasing importance because of more and more stringent noise pollution legislation, which in some locations makes ordinary fly shuttle looms legally unacceptable. The Stahl and Cudworth patent does not change the nature of the conventional binder except by elastomer lining to reduce noise and transmission of vibrations to the loom frame.

SUMMARY OF THE INVENTION

The present invention is concerned with an improved binder for the shuttle boxes of fly shuttle looms. The binder is a single piece of resilient elastomer of high flex life which is attached to the shuttle box elements at both ends. Instead of being pivoted, when a shuttle enters the shuttle box the binder bows out in the middle, exerting a powerful force against the shuttle which provides greater friction for decelerating an incoming shuttle and reducing picker stick overshoot. The binder is, of course, lined with leather, as is conventional. Noise is reduced because there are no rigid elements connecting to the loom frame, and the increased friction on the shuttle makes it possible in some cases, when properly adjusted, to eliminate elements that are normally needed with a conventional pivoted binder. These elements, for example, are loom side bumper for the picker stick on its forward throw and check straps restraining the motion of the picker stick on its reverse movement. Under favorable conditions and under proper adjustment in many cases these elements can be eliminated by the present invention without, of course, eliminating their function.

The greatly increased friction exerted on the shuttle by the bowing of the binder also reduces vibration in the loom operation and, due to the inherent properties of the binder material, transmission of vibrations or noise is reduced. The present invention is not limited in its broadest aspects to a loom in which loom side picker stick bumpers and picker stick check straps are eliminated but in a more preferred specific aspect the elimination of these elements without eliminating their function is included in the invention.

It should be noted that the binder of the present invention behaves essentially as a solid elastomer and is not compressible to a degree which exerts a significant force on the shuttle, the only effective force being the bowing or flexing of the elastomer when the shuttle enters the box. As some heat is produced by flexing, it is often desirable to provide a few large, vertical ventilatingholes near the center of the elastomer where the bowing produces maximum flexing. The holes are relatively large and few in number; for example, they may be about ⅝ in. in diameter, and they are not oblong or slanted and therefore contribute little additional compressibility to the binder. This is not a significant component of the force slowing down the shuttle as if it were attempted to provide a rigid backing plate as described in the preferred forms of the British patent referred to above the compressibility of the elastomer, although not zero, is insufficient to slow down the shuttle and to permit it to enter the box. This is quite a different order of magnitude of compressibility from that described in the British patent where the slanted oblong holes allow very extensive compressibility which is not the case with the few large vertical ventilating holes. In other words, the operation of the British patent and of the present invention are quite different. In the British patent, the briefly mentioned alternative depends for its braking force on compression of the elastomer whereas in the present invention this force contributes an insignificant amount of force to decelerate the shuttle. The force from the bowing out or flexing of the elastomer is so much greater that, as has been stated above, if compressibility of the elastomer where the only force it is insufficient to perform the functions of the binder of the present invention. For the reasons stated, in the specification and claims, the elastomer will be referred to as substantially solid because the ventilating holes, if used at all, and of course the bolt holes where the elastomer is fastened to the loom do not substantially alter the nature of the binder, which behaves substantially as if it were a solid piece of elastomer. Also, where reference is made to the flexing or bowing as being the only significant force, this is not intended to mean that the elastomer is completely incompressible; in fact few materials are. Therefore, the wording is to be interpreted that the flexing or bowing is the only significant force decelerating the shuttle. In other words, the present invention is directed to a practical machine and not theoretical physics.

The improved friction exerted by the binder of the present invention is obtained without additional cost as the elastomer binder is quite economical and it has adequate life; and even when replacement is needed, this can be very rapidly effected with two bolts threaded into tapped holes on the loom. No other changes need to be made to the loom except that in one modification the dagger finger has to be moved from the end of the shuttle box to approximately the middle of the length of the binder where deflection by contact with the shuttle is a maximum and produces adequate movement to actuate the dagger finger and through its conventional mechanism declutching the loom drive momentarily.

In a modification of the present invention which is a preferred embodiment there is pivoted on the end of the elastomer binder an extension so that when the shuttle enters the box this pivoted extension moves readily and permits the dagger finger to remain in the same position as it is in a conventional loom, that is to say, where it is contacted with the free end of the pivoted, rigid binder. While the repositioning of the dagger finger and its linkage to the drive clutch is not expensive, it does involve some modification of the loom shuttle boxes. As the cost of a pivoted extension is negligible this embodiment is normally preferred though the invention is not limited in its broadest aspect thereto and includes an elastomer binder without an extension.

Reference has been made in an earlier section of the specification to a Stahl and Cudworth patent reducing noise and transmission of vibration to the loom frame by suitable elastomer lining of binders, back box plates, lay end plates and the like and also other elements of the loom, and it is an advantage of the present invention that the noise reducing features of the Stahl and Cudworth patent can be applied. However, it should be understood that in its broader aspects the invention is not limited to the features of the Stahl and Cudworth patent. It should be noted in connection with noise reduction that the elastomer binder in and of itself also reduces noise by the elimination of any rigid element connecting to the loom frame. Thus when used with the Stahl and Cudworth patent, noise reduction is still further improved.

The elastomer in the binder of the present invention may be any elastomer which has the proper characteristics. The elastomer must have a relatively long flex life as some elastomers which have the adequate elasticity have short flex lives and, therefore, while operative are not particularly useful as binders would have to be replaced at too short intervals. Elastomers having adequate flex life are well known commercial products and any of them may be used. Some polyurethane elastomers have adequate flex life and can, therefore, be used. An example of a typical elastomer having the characteristics of long flex life is the elastomer sold under the trade name of "Hytrel," which as excellent flex life and for many purposes is the preferred elastomer. So long as the elastomer has adequate flex life any of the known elastomers may be used, and therefore the present invention does not distinguish from the prior art by using one particular unique elastomer and includes any of the well known high flex life elastomers.

BRIEF DESCRIPTION OF THE DRAWINGS

FIG. 3 is a detail of the binder and box and shows a shuttle entering the box;

FIG. 4 is an enlarged detail of an elastomer binder without pivoted extension;

FIG. 5 is a similar detail of an elastomer binder with a pivoted extension, and

FIG. 6 is a detail of a picker stick overshoot bumper.

DESCRIPTION OF THE PREFERRED EMBODIMENTS

Figure 1:
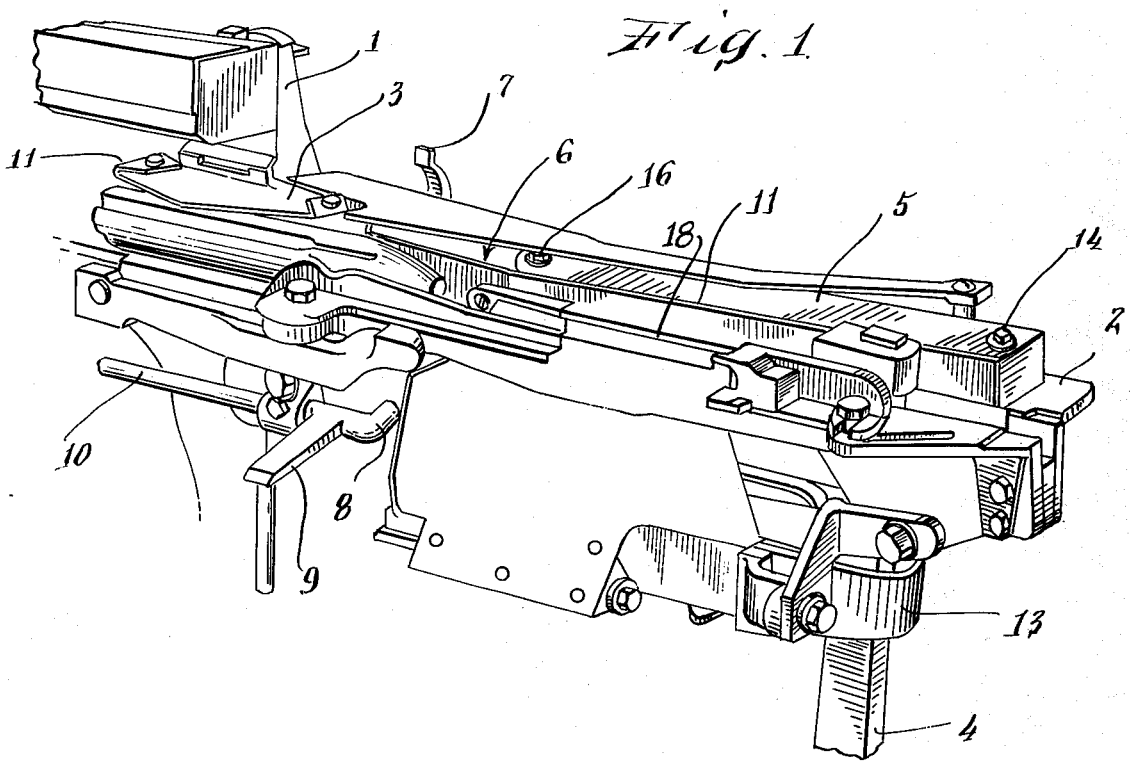
FIG. 1 is a front perspective view of a portion of a right hand shuttle box.

FIG. 1 shows a right hand shuttle box with a binder of the pivoted extension type shown in FIG. 5. The shuttle box includes a loom frame 1, shown broken away because only the portion of the loom which requires illustration showing where the present invention attaches is illustrated. There is a lay end plate 2, a back box plate 3, a picker stick 4 and a binder 5, fastened to the loom by bolts 14 and 16. The binder is illustrated with pivoted extension 6. FIG. 1 shows this extension, which is on the incoming end of the shuttle box, to move and actuate the dagger finger, which operates through a protector rod 10 having a dagger 9 this is in its horizontal position as shown in FIG. 1. As this protector rod is of conventional design it is shown purely diagrammatically. When a shuttle enters the box, the binder extension 6 pivots out, moving the dagger 9 up. The operation of the dagger and clutch mechanism is unchanged from that of a conventional loom. The binder is lined with leather 11, the surface of which shows in FIG. 1. In an ordinary loom with a pivoted wood binder it is customary to have an elastic insert back of the leather so that it will give more. The elastic cushioning may be rubber, cork, or anything which is capable of slight resilience. This resilient cushion cannot be seen in FIG. 1 as it is back of the leather lining but it is desirable in many cases with the elastomer binders of the present invention. In FIG. 3, however, the edge of the resilient cushion 17 can be seen.

Figure 2:
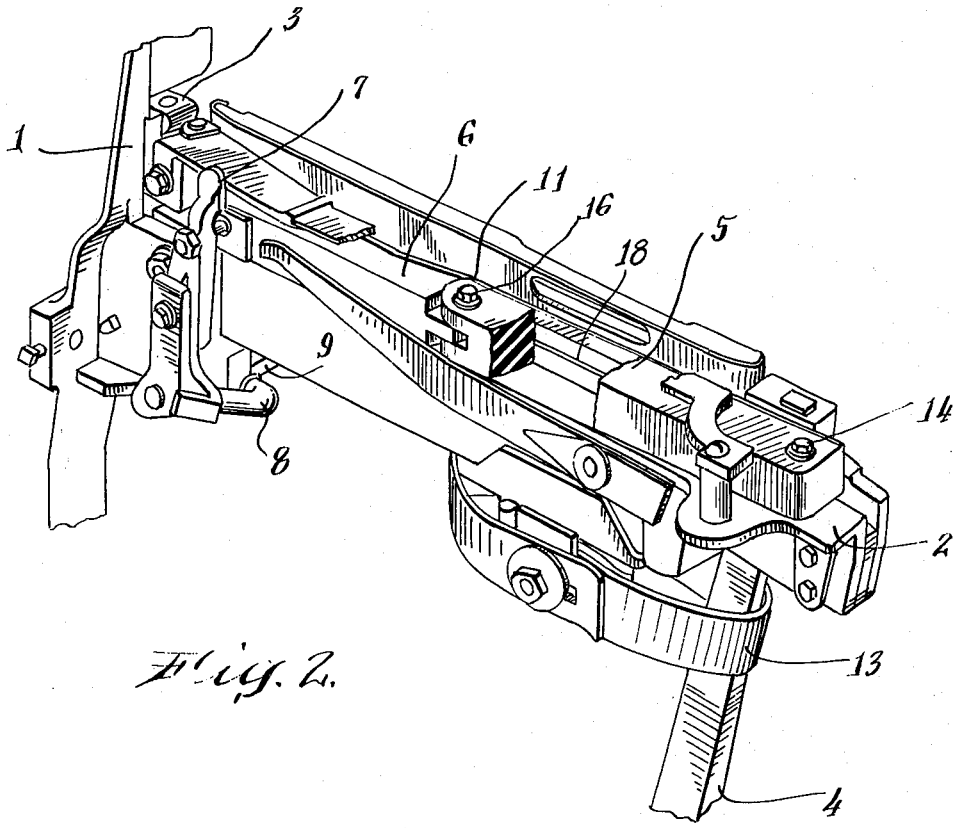
FIG. 2 is a rear perspective view of a left hand shuttle box.

FIGS. 1 and 2 also show elastomer linings 18 as described in the Stahl and Cudworth application. The present invention is not limited to use with elastomer linings of the Stahl and Cudworth application and in such a case, of course, these linings are omitted.

FIG. 2 is a left hand shuttle box or portion of it which might be considered as looking at FIG. 1 from the other side. The various elements are given the same numbers. As FIGS. 1, 2 and 3 are not views which can show a picker stick overshoot bumper, this is illustrated in FIG. 6, which is a detail of a conventional bumper 12. This is a small detail showing the bumper adjustably attached to a portion of the loom frame. As this bumper is not changed, if used in the present invention, FIG. 6 does not require detailed discussion or description However, the bumper is illustrated because, as has been pointed out above, in some circumstances when the elastomer binder is used and there is accurate adjustment of the whole loom it is possible to eliminate the bumper. FIG. 2 shows also the picker stick with a check strap 13, which, in suitable circumstances, may also be eliminated, as has been mentioned above. Otherwise the elements are the same. However an elastic binder without a pivoted extension is shown in FIG. 4, and this requires that the dagger finger be moved to the center of the binder, and of course, this requires a relocation of the dagger finger. In other words, modification of the shuttle boxes in the loom is necessary. As these modifications are at least as expensive as the hinged extension on the binder, the modification shown in FIGS. 1, 2 and 5 is preferred.

FIG. 4 shown in perspective a binder without a pivoted extension. The showing of the dagger finger 7 and the dagger 9 are purely diagrammatic to illustrate their location. It will be seen that in FIG. 4 there are two bolt holes, one vertical 14 and one horizontally through the binder, 15. In FIG. 5 the bolt hole for bolt 14 is the same, instead of a bolt hole 15 the pivot bolt 16 which holds the pivoted extension serves also to secure the binder. This requires drilling and tapping a hole to take a vertical bolt through the hole 16. This, however, is a very minor change or modification of a loom compared to the relocation of the dagger finger 7, which is needed in FIGS. 2 and 4. For this reason, as has been pointed out above, the binder with a pivoted extension is preferred.

It will be noted that both FIGS. 4 and 5 show the optional vertical ventilating holes 19 in the elastomer. As has been pointed out above, these holes, which are normally round and of the order of about ⅝ inch in diameter, do not render the elastomer sufficiently compressible so that if it were mounted on a rigid plate the loom would be operative. In other words, even with some vertical ventilating holes the elastomer behaves substantially as if it were solid, and in the claims where this wording is used it is intended to cover elastomer binders of the present invention with or without ventilating holes.

We claim:

1. An improved binder for each shuttle box of fly looms, each binder comprising a leather lining, substantially solid, not significantly compressible high flex life elastomer, each binder being fastened to its respective shuttle box at both ends and positioned so as to encounter the shuttle on entering and while in the shuttle boxes, the elastomer binder being insufficiently compressible to operate except by the bowing out of the binder as the shuttle proceeds in the box, the only significant force decelerating the shuttle as it moves in the box being the force of bowing of the elastomer binder.

2. A binder according to claim 1 in which on the end of each binder in its box toward the loom there is pivoted an elastomer extension, a pivoted extension being oriented to contact the conventional dagger finger in its usual position adjacent the loom end of the binder.

3. A binder itself according to claim 1 in which the binder is provided with a two-layer lining, the outer layer of leather and an inner layer which is a resilient material.

4. A binder according to claim 1 having at least one vertical hole through the elastomer of each binder to provide ventilation.

* * * * *